US005678161A

United States Patent [19]

Kurotaka et al.

[11] Patent Number: 5,678,161

[45] Date of Patent: Oct. 14, 1997

[54] PAPER CONVEYER OF IMAGE FORMING APPARATUS WHICH CONVEYS PAPER TO A FIXING DEVICE

[75] Inventors: Shigeo Kurotaka; Nobuo Iwata, both of Sagamihara; Shingo Katou, Yokohama; Takeshi Motohashi, Kawasaki; Tsuyoshi Deki, Koshigaya; Takahiro Tamiya, Tokyo; Tomonori Yabuta, Yokohama, all of Japan

[73] Assignee: Ricoh Company, Ltd., Tokyo, Japan

[21] Appl. No.: 595,340

[22] Filed: Feb. 1, 1996

[30] Foreign Application Priority Data

Feb. 3, 1995 [JP] Japan ..... 7-017133
Jan. 17, 1996 [JP] Japan ..... 8-006006

[51] Int. Cl.[6] ..... G03G 15/00; G03G 15/20

[52] U.S. Cl. ..... 399/400; 399/331

[58] Field of Search ..... 355/282, 285, 355/290, 295, 309, 308, 271, 275; 219/216, 469–471; 399/320, 330, 331, 68, 397, 400, 322

[56] References Cited

U.S. PATENT DOCUMENTS 3,945,726 3/1976 Ito et al. ..... 355/290 X
4,355,881 10/1982 Tarumi et al. ..... 355/282
4,627,813 12/1986 Sasaki ..... 219/216 X
4,714,338 12/1987 Iida et al. ..... 355/285
5,142,339 8/1992 Kasahara et al. ..... 355/282
5,515,151 5/1996 Velazquez ..... 355/308

FOREIGN PATENT DOCUMENTS 1-251070 10/1989 Japan ..... 355/290
1-251071 10/1989 Japan ..... 355/290

*Primary Examiner*—S. Lee
*Attorney, Agent, or Firm*—Oblon, Spivak, McClelland, Maier & Neustadt, P.C.

[57] ABSTRACT

In a paper conveyer of an image forming apparatus, a transfer operation is performed by a transfer roller and an unfixed image in the transfer operation is carried onto the lower side of a transfer paper sheet. The transfer paper sheet is conveyed to a fixing device constructed by a fixing roller and a pressurizing roller. A hardness of the fixing roller is smaller than that of the pressurizing roller, while a nipping portion of the fixing and pressurizing rollers is formed in a concave shape. The fixing and pressurizing rollers are arranged such that a nipping inlet port point of the fixing and pressurizing rollers is located in the vicinity of a line of a conveying locus of a thin transfer paper sheet. A paper guide plate guides the transfer paper sheet to the nipping inlet port. In this construction, a transferred paper sheet is conveyed such that this transferred paper sheet is reliably fed into the nipping portion of the fixing device, and it is possible to prevent an image rub, wrinkles, a jam, etc. from being caused.

12 Claims, 7 Drawing Sheets

PAPER CONVEYER OF IMAGE FORMING APPARATUS WHICH CONVEYS PAPER TO A FIXING DEVICE

BACKGROUND OF THE INVENTION

1. Field of the Invention

The present invention relates to a paper conveyer for conveying a sheet of transfer paper from a transfer position into a fixing device in an image forming apparatus of a system in which an unfixed toner image is held on a lower face of the transfer paper sheet.

2. Description of the Related Art

As shown in FIG. 1, there is a general system for transferring a toner image onto a lower face of a sheet of transfer paper by a transfer roller 3 and conveying and fixing the transfer paper sheet to a fixing device 12 in an image forming apparatus of an electrophotographic system such as a laser printer, etc.

In this image forming apparatus, jam processing of the transfer paper sheet, etc. can be easily performed. Further, no transfer paper sheet reversing mechanism is particularly required since a firm transfer paper sheet such as a thick paper sheet is linearly conveyed and is discharged with a printed face as a lower face. Furthermore, the image forming apparatus can be made compact, cost thereof can be reduced, and operability of the image forming apparatus is improved.

However, in this system, the toner image is held on the lower face of the transfer paper sheet so that it is difficult to make the transfer paper sheet carrying the transferred and unfixed toner come in contact with another member and reliably guide into a nipping inlet port of the fixing device 12 without disturbing the toner image in an unfixed state. Since no guide plate is arranged on the lower face of the transfer paper sheet, the transfer paper sheet fed from a transfer section is directed to the nipping inlet port of the fixing device 12 in an unstable state while the transfer paper sheet hangs down by its empty weight.

Hanging-down characteristics of this transfer paper sheet are changed in accordance with conditions of rigidity of the transfer paper sheet, temperature, humidity, a conveying direction of the transfer paper sheet after transfer, etc. Therefore, it is difficult to reliably guide a front end of the transfer paper sheet to the nipping inlet port of the fixing device 12. Accordingly, there are also problems of wrinkles, a jam caused in fixing in addition to the above problem of an image rub.

As a first example of countermeasures of these problems, Japanese Patent Application Laying Open (KOKAI) No. 62-153865 shows a method for making an upper face of the transferred paper sheet come in contact with a guide plate and guiding the paper sheet into the fixing device in a state in which a feeding direction of the transfer paper sheet is set to a lower side.

As a second example of the above countermeasures, Japanese Patent Application Laying Open (KOKAI) No. 2-73373 shows a method for guiding the transfer paper sheet into the inlet port of the fixing device while the transfer paper sheet fed from a transfer section is drawn upward by a means for causing an electrostatic adsorbing action on a conveying roller arranged above this transfer paper sheet.

As a third example of the above countermeasures, Japanese Patent Application Laying Open (KOKAI) No. 2-231355 shows a conveyer in which a guide member of the transfer paper sheet is arranged from a transfer section to a fixing section and the transfer paper sheet is drawn upward by an air sucking device arranged above the guide member. In the above three examples, a corona charger is used as a transfer means. However, a transfer roller is recently used in many cases to reduce a generating amount of ozone, etc.

However, in the first example of the paper conveyer of the above general image forming apparatus, the transferred paper sheet is conveyed while this paper sheet hangs down. Therefore, there is a problem of great scatter of a conveying locus of this paper sheet in accordance with its rigidity, temperature, humidity, etc. It is difficult to reliably convey and fix the transfer paper sheet by the fixing device by only this construction so that no satisfied effects can be obtained.

In the second example, the conveying roller and an electrostatic applying device are separately required as a paper conveying means. In the third example, an air sucking device is required. Accordingly, it is necessary to form spaces for arranging the conveying roller and these devices between the transfer section and the fixing section. Therefore, the entire image forming apparatus is large-sized and cost thereof is increased.

There is a proposal of preventing scatter of the conveying locus of the paper sheet by adjusting the rigidity of the transfer paper sheet by reducing a distance between the transfer and fixing sections as much as possible although this proposal is not known.

However, when the distance between the transfer and fixing sections is short in a color image forming apparatus using an intermediate transfer member such as a roller, a belt, etc., toner tends to be fixed onto the intermediate transfer belt and toner blocking tends to be caused within a cleaner of this intermediate transfer belt.

SUMMARY OF THE INVENTION

It is therefore an object of the present invention to provide a paper conveyer of an image forming apparatus in which a transferred paper sheet is conveyed such that this transferred paper sheet is reliably fed into a nipping portion of a fixing device, and it is possible to prevent an image rub, wrinkles, a jam, etc. from being caused, such that the image forming apparatus can be cheaply manufactured and simply constructed.

In accordance with a first construction of the present invention, the above object can be achieved by a paper conveyer of an image forming apparatus in a system in which a transfer operation is performed by a transfer device and an unfixed image in the transfer operation is carried onto the lower side of a transfer paper sheet and the transfer paper sheet is conveyed to a fixing device constructed by a fixing roller and a pressurizing roller;

the fixing roller and the pressurizing roller being arranged such that a nipping inlet port point of these rollers is located in the vicinity of a line of a conveying locus of a thin paper sheet until a transfer paper sheet having the smallest rigidity among transfer paper sheets used in this image forming apparatus is conveyed from a transfer position to a fixing position of the fixing device; and the paper conveyer has a paper guide plate for guiding the transfer paper sheet from the transfer position to the nipping inlet port and is arranged such that the transfer paper sheet is guided in sliding contact with the paper guide plate between the transfer device and the fixing device.

A nipping shape of the transfer paper sheet is formed in a concave shape on a pressurizing roller side by a press contact of the fixing roller and the pressurizing roller.

The hardness of the fixing roller is smaller than the hardness of the pressurizing roller.

Each of the fixing roller and the pressurizing roller is constructed by an elastic member.

The transfer device is constructed by a transfer roller and an intermediate transfer member coming in press contact with this transfer roller.

In accordance with a second construction of the present invention, the fixing roller and the pressurizing roller are arranged such that a straight line connecting a center of this pressurizing roller to the nipping inlet port point is approximately perpendicular to a tangential line at a point on the thin paper conveying locus at this nipping inlet port point or a point on the thin paper conveying locus in the vicinity of the nipping inlet port point.

In accordance with a third construction of the present invention, the transfer roller and the intermediate transfer member are arranged such that a front end of the transfer paper sheet passing through a nipping portion of the transfer roller and the intermediate transfer member is directed upward.

In accordance with a fourth construction of the present invention, the hardness of the transfer roller is set to be larger than the hardness of the intermediate transfer member; and a nipping shape of the transfer roller and the intermediate transfer member is set to a concave shape such that a front end of the transfer paper sheet passing through a nipping portion of the transfer roller and the intermediate transfer member is directed upward.

In accordance with a fifth construction of the present invention, the paper guide plate is arranged such that:

a guide face of the paper guide plate at its front end is approximately perpendicular to a straight line connecting a center of the pressurizing roller to the nipping inlet port point; and an extension line of a straight line included on the guide face of the paper guide plate at its front end is located at the nipping inlet port point or is located above and near the nipping inlet port point.

In accordance with a sixth construction of the present invention, the paper guide plate is constructed such that one face portion of the paper guide plate coming in sliding contact with the transfer paper sheet is formed in a shape approximately conforming to the thin paper conveying locus.

In accordance with a seventh construction of the present invention, one of the transfer roller and the intermediate transfer member is formed in a crown shape in which it is gradually thinned toward its axial central portion; and the other is formed in a reverse crown shape following this crown shape in which the other comes in contact with the one of the transfer roller and the intermediate transfer member.

As explained above, in the first construction, hardness the of the fixing roller is smaller than that of the pressurizing roller. A nipping shape of the transfer paper sheet is formed in a concave shape by a press contact of the fixing and pressurizing rollers. The fixing roller and the pressurizing roller are arranged such that a nipping inlet port point of these rollers is located in the vicinity of a line of a conveying locus of a thin paper sheet. The paper guide plate is arranged such that the transfer paper sheet is guided in sliding contact with the paper guide plate between the transfer roller and the fixing device. Accordingly, various kinds of transfer paper sheets are conveyed from a transfer section along the paper guide plate in accordance with the thin paper conveying locus irrespective of a large or small rigidity of each of the transfer paper sheets. Therefore, each of the transfer paper sheets is smoothly fed into the nipping inlet port without any problem.

In the second construction, the fixing roller and the pressurizing roller are arranged such that a straight line connecting a center of this pressurizing roller to the nipping inlet port point is approximately perpendicular to a tangential line at a point on the thin paper conveying locus at this nipping inlet port point or a point on the thin paper conveying locus in the vicinity of the nipping inlet port point. Accordingly, the transfer paper sheet is naturally fed from the nipping inlet port into the nipping portion without any problem. Therefore, operations similar to those of the first construction are performed.

In the third construction, the transfer roller and the intermediate transfer member are arranged such that a front end of the transfer paper sheet passing through a nipping portion of the transfer roller and the intermediate transfer member is directed upward. Accordingly, a conveying locus of the transfer paper sheet is closer to a horizontal locus and a scatter of the conveying locus caused by the large or small rigidity of the transfer paper sheet is reduced so that the transfer paper sheet is more reliably fed into the nipping port. Further, since the conveying locus of the transfer paper sheet is closer to the horizontal locus, it is not necessary to lower a position of the fixing device so that the entire image forming apparatus can be made compact.

In the fourth construction, the hardness of the transfer roller is set to be larger than that of the intermediate transfer member. A nipping shape of the transfer roller and the intermediate transfer member is set to a concave shape so that a front end of the transfer paper sheet passing through a nipping portion of the transfer roller and the intermediate transfer member is directed upward. Accordingly, operations similar to those of the third construction are performed.

In the fifth construction, the paper guide plate is arranged such that:

a guide face of the paper guide plate at its front end is approximately perpendicular to a straight line connecting a center of the pressurizing roller to the nipping inlet port point; and an extension line of a straight line included on the guide face of the paper guide plate at its front end is located at the nipping inlet port point or is located above and near the nipping inlet port point. Accordingly, the transfer paper sheet is directly fed to the nipping inlet port, or passes through the front end of the paper guide plate. Thereafter, the transfer paper sheet is naturally fed into the nipping port without any problem while the transfer paper sheet is guided by the pressurizing roller. Thus, operations similar to those of the second construction are performed.

In the sixth construction, the paper guide plate is constructed such that one face portion of the paper guide plate coming in sliding contact with the transfer paper sheet is formed in a shape approximately conforming to the thin paper conveying locus. Accordingly, the transfer paper sheet is smoothly conveyed since resistance of the transfer paper sheet is reduced when the transfer paper sheet is slid along the paper guide plate. Thus, it is possible to prevent the transfer paper sheet from being jammed, etc. irrespective of a large or small rigidity of the transfer paper sheet.

In the seventh construction, one of the transfer roller and the intermediate transfer member is formed in a crown shape in which it is gradually thinned toward its axial central portion. The other is formed in a reverse crown shape following this crown shape in which the other comes in contact with the one of the transfer roller and the intermediate transfer member. Accordingly, when the transfer paper sheet passes through this curved nipping portion, the transfer paper sheet has firmness so that rigidity is provided to the transfer paper sheet. Thus, a conveying locus of the transfer paper sheet is closer to a horizontal locus. Accordingly, operations similar to those of the third construction are performed.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a paper conveyer of an image forming apparatus in the present invention will next be described in detail with reference to the accompanying drawings.

Figure 1:
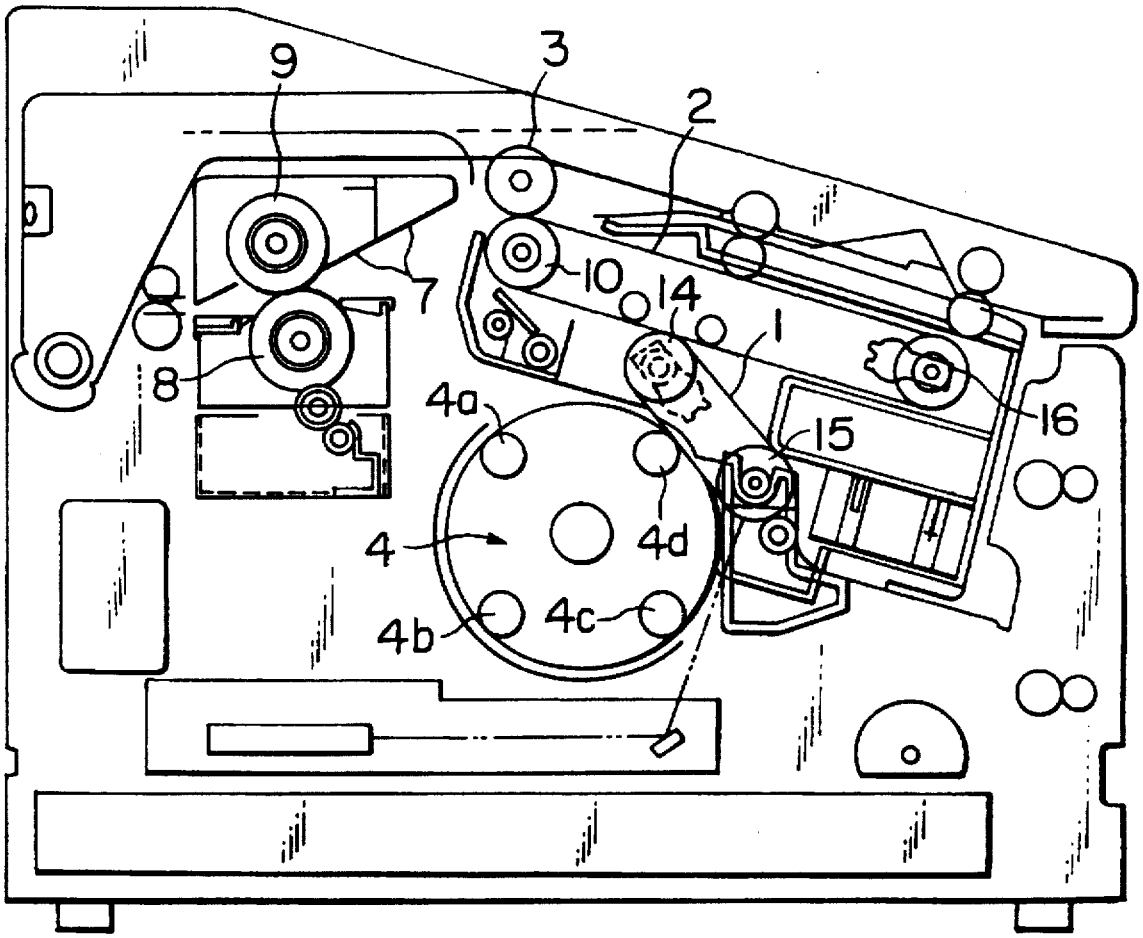
FIG. 1 is a schematic constructional view showing a full color printer in an embodiment relative to the present invention.

In FIG. 1, a photosensitive body belt 1 is supported and tensioned between a drive roller 14 and a driven roller 15. A rotating type multicolor developing device 4 and an intermediate transfer belt 2 come in contact with the photosensitive body belt 1. The intermediate transfer belt 2 is supported and tensioned between a drive roller 16 and a belt supporting roller 10. The rotating type multicolor developing device 4 is sequentially constructed by yellow 4*a*, magenta 4*b*, cyan 4*c* and black 4*d*. A transfer roller 3 comes in contact with the intermediate transfer belt 2 in a position of the belt supporting roller 10. An intermediate transfer member is constructed by this belt supporting roller 10 and the intermediate transfer belt 2.

Figure 2:
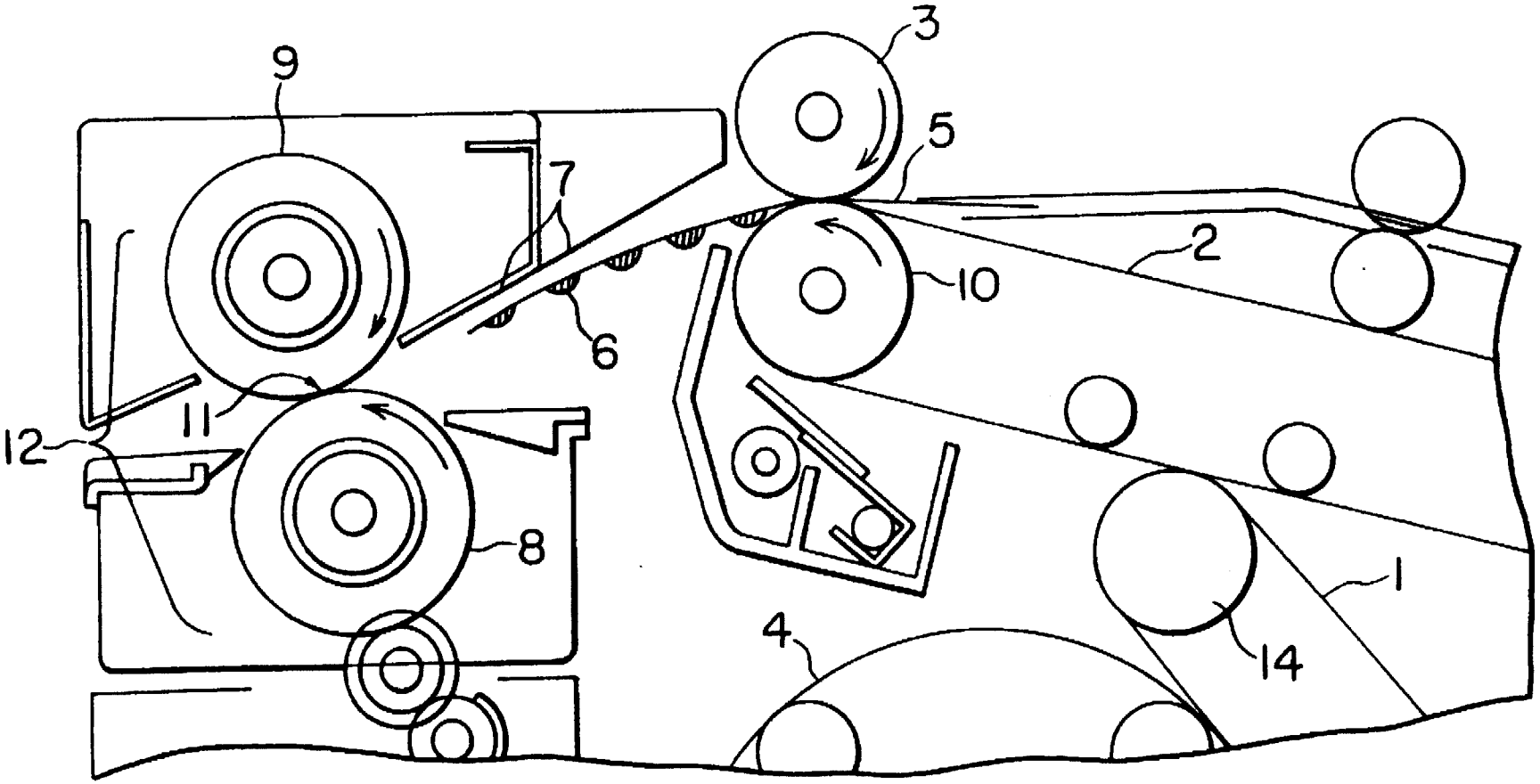
FIG. 2 is a schematic constructional view showing a paper conveyer of an image forming apparatus (of a full color printer) in an embodiment of the present invention.

As shown in FIG. 2, a fixing device 12 is arranged on a downstream side of the transfer roller 3 and the belt supporting roller 10. The fixing device 12 forms a fixing nipping portion 11 by making a pressurizing roller 9 come in contact with a fixing roller 8. In the following description, this fixing nipping portion 11 is called a nipping portion 11. A paper guide plate 7 is arranged such that a sheet 5 of transfer paper is guided to this nipping portion 11.

In this construction, a toner image is sequentially formed on the photosensitive body belt for every one of yellow 4*a*, magenta 4*b*, cyan 4*c* and black 4*d* by rotating the rotating type multicolor developing device 4. Thereafter, this toner image is overlapped and transferred onto the intermediate transfer belt 2. Next, these toner images are transferred together onto a lower face side of the transfer paper sheet 5 as a full color toner image by the transfer roller 3 so that an unfixed image (toner image) 6 is formed.

The transferred paper sheet 5 is fed by the paper guide plate 7 to the nipping portion 11 formed in a press contact state of the fixing roller 8 and the pressurizing roller 9. Thus, the transferred paper sheet 5 is fixed.

The paper conveyer of the present invention is constructed by the transfer roller 3, the paper guide plate 7 and the nipping portion 11 formed by the fixing roller 8 and the pressurizing roller 9.

A conveying method of the paper sheet from the transfer section, a shape of the paper guide plate 7, its attaching position, a position and a shape of the nipping portion 11, etc. are optimally determined by these basic constructions to solve problems of conveyance of the transfer paper sheet 5 between the transfer section and a fixing section. The transfer paper sheet 5 is stably fed from the transfer section to the fixing section. Explanations about such construction and operation will next be described for every claimed construction.

Figure 3:
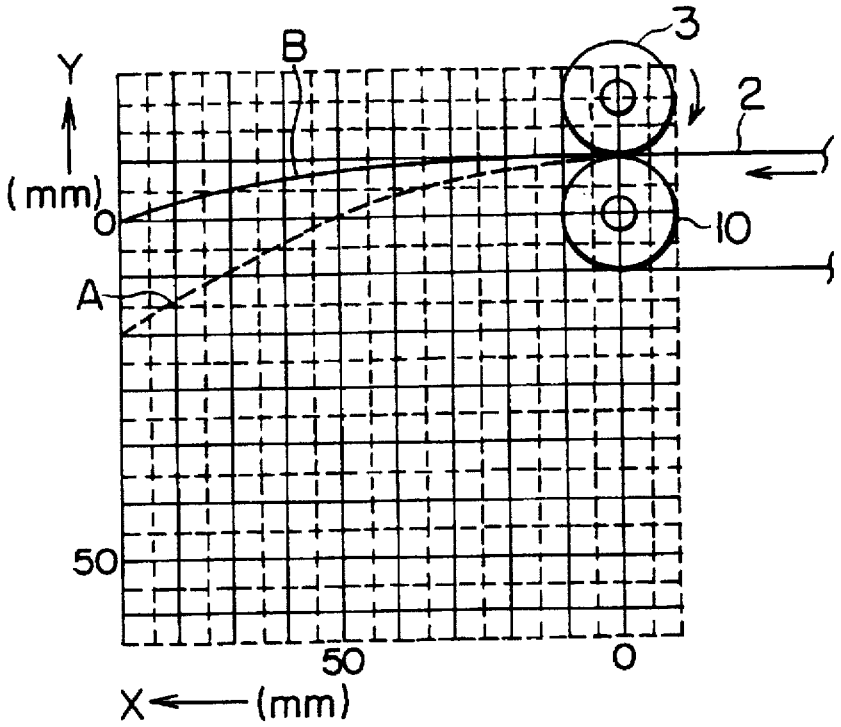
FIG. 3 is a view showing characteristic lines each showing a conveying locus of a sheet of transfer paper.

An embodiment based on a first construction of the present invention will first be described. FIG. 3 shows conveying loci of the transfer paper sheet 5 drawn by measuring hanging-down characteristics of the transfer paper sheet 5 when the transfer paper sheet 5 is fed from the transfer section in a fixing direction. In FIG. 3, a dotted line A shows a conveying locus of a thin paper sheet having smallest rigidity among transfer paper sheets used in this apparatus, for example equivalent to 45 kg paper sheet (basis weight of about 50 g/m$^2$). A solid line B shows a conveying locus of a thick paper sheet having largest rigidity among the transfer paper sheets used in this apparatus, for example equivalent to 135 kg paper sheet (basis weight of about 150 g/m$^2$). An axis Y of ordinate shows a distance from a transfer outlet port in a height direction (one scale shows 5 mm). An axis X of abscissa shows a distance from the transfer outlet port in a transversal direction toward the fixing device 12 (one scale shows 5 mm).

Figure 4:
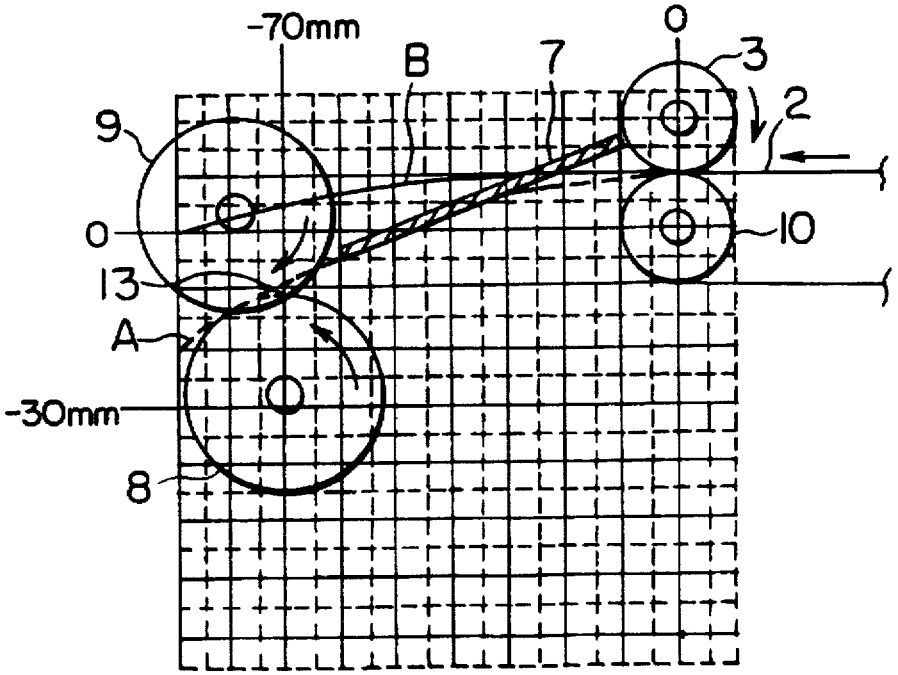
FIG. 4 is a schematic constructional view showing a paper conveyer in an embodiment based on a first construction of the present invention.

In the apparatus construction in this embodiment, as shown in FIG. 4, a nipping inlet port point 13 of the fixing device 12 is arranged on the conveying locus A of the thin paper sheet or is arranged near and below this thin paper conveying locus A. In the following description, this nipping inlet port point 13 is called a nipping inlet port P 13. The paper guide plate 7 is arranged such that the transfer paper sheet 5 is guided to the nipping inlet port point 13. Thus, a transfer paper sheet from the transfer paper sleet having smallest rigidity to a transfer paper sheet having larger rigidity reaches this nipping inlet port point 13 while this transfer paper sheet is slid along the paper guide plate 7.

A central coordinate of the belt supporting roller 10 is set to an origin and the abscissa axis X=−70 mm and the ordinate axis Y=−28 mm are set in a central position of the fixing roller 8, and a front end of the paper guide plate 7 is located on the conveying locus A of the thin paper sheet such that the nipping inlet port point 13 is arranged near and below the conveying locus A of the thin paper sheet.

Hardness of the fixing roller 8 is set to be smaller than hardness of the pressurizing roller 9 so that the nipping portion 11 is formed in a concave shape. Thus, all paper sheets used in this apparatus are naturally fed into the nipping portion 11 along the paper guide plate 7 without any problem while each of the paper sheets first comes in contact with the pressurizing roller 9.

Figure 5A:
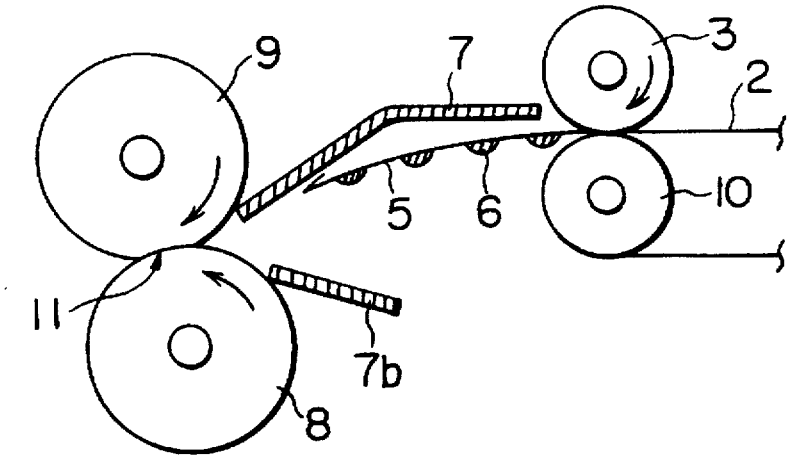
FIGS. 5*a* and 5*b* are each an explanatory view showing the operation of a nipping portion of a fixing device in the first construction when the nipping portion is formed in a convex shape.
Figure 5B:
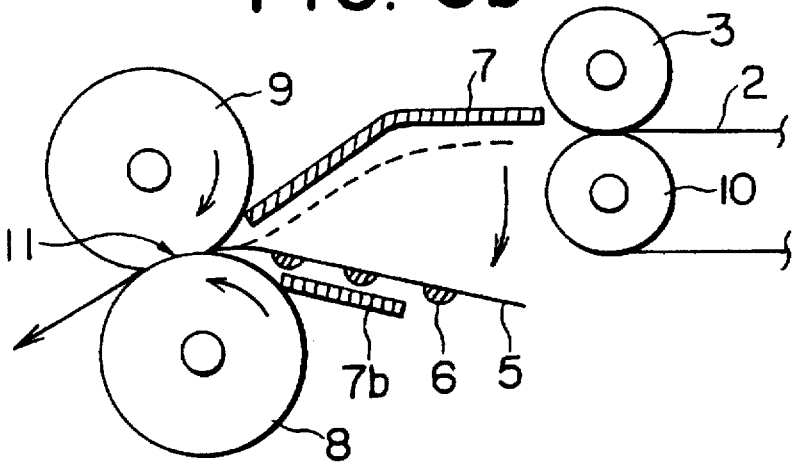

If the nipping portion 11 is conversely formed in a convex shape as shown in FIG. 5*a*, it is difficult to properly arrange front ends of the transfer paper sheets 5 and make these front ends uniformly enter into the nipping portion 11 without any problem. Accordingly, wrinkles of the transfer paper sheets 5 tend to be caused. In the worst case, the front end of a transfer paper sheet 5 is not inserted into the nipping portion 11, but is jammed at the nipping inlet port point 13. As shown in FIG. 5*b*, when a rear end of the transfer paper sheet 5 is fed to the nipping portion 11 after this rear end has passed through a transfer position, this rear end hangs down since the nipping portion is formed in a convex shape. Thus, a face of an unfixed image 6 comes into rubbing contact with a lower portion 7*b* of the paper guide plate so that this rubbing contact has a bad influence on the unfixed image.

Figure 6:
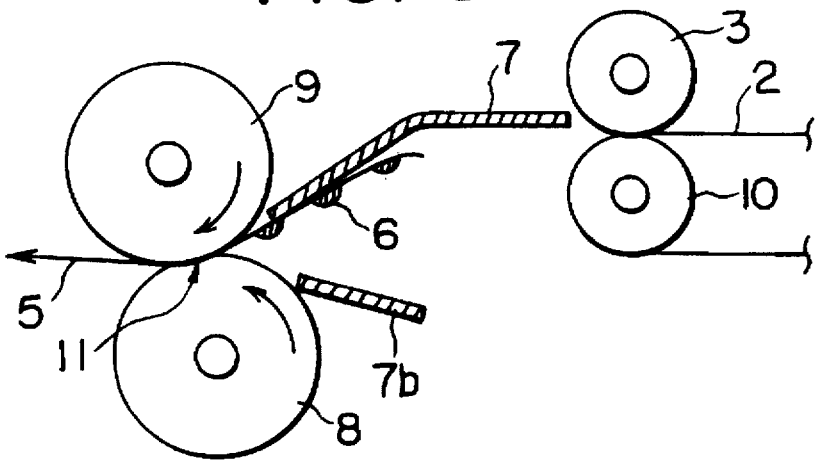
FIG. 6 is an explanatory view showing an operation of the paper conveyer in the embodiment based on the first construction.

Therefore, when the nipping portion 11 is formed in a convex shape as in this embodiment, the rear end of the transfer paper sheet 5 is warped toward the paper guide plate 7 when the transfer paper sheet 5 is fed to the fixing nipping portion 11 as shown in FIG. 6. Thus, no image comes into rubbing contact with the lower portion 7*b* of the paper guide plate.

Figure 7:
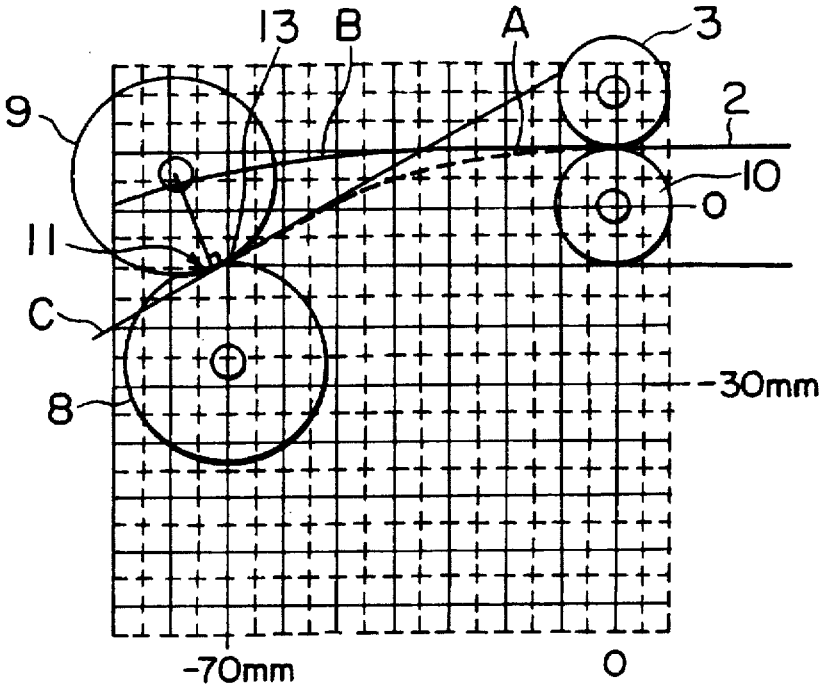
FIG. 7 is a schematic constructional view showing a paper conveyer in an embodiment based on a second construction of the present invention.

An embodiment based on a second construction of the present invention will next be explained with reference to FIG. 7. A basic construction of this embodiment is approximately similar to that of the embodiment of the first construction. The differences in construction between these embodiments are as follows. Namely, when the nipping inlet port point 13 is located on the conveying locus A of a thin paper sheet as shown in FIG. 7 or is not located on this conveying locus A, a straight line connecting the nipping inlet port point 13 to a center of the pressurizing roller 9 is set to be approximately perpendicular to a tangential line C of the conveying locus A of the thin paper sheet at a point located in the vicinity of the nipping inlet port point 13. In this construction, the transfer paper sheet 5 is further naturally fed into the nipping portion 11 without any problem in comparison with the first construction.

Figure 8:
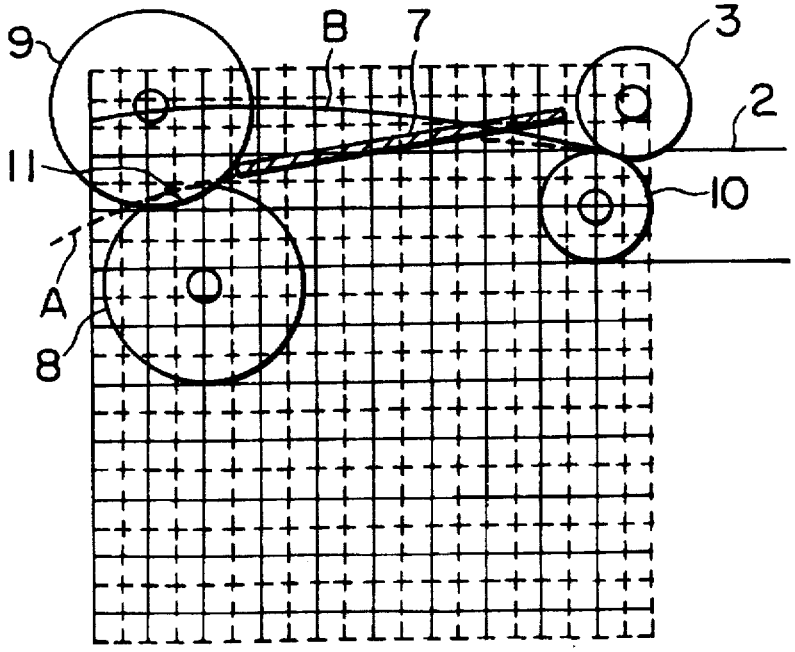
FIG. 8 is a schematic constructional view showing a paper conveyer in an embodiment based on a third construction of the present invention.

Embodiments based on third to seventh constructions of the present invention will next be explained. A basic construction of the embodiment based on the third construction is approximately similar to that of the embodiment of the first construction. The differences between these basic constructions are as follows. Namely, as shown in FIG. 8, a transfer position of the transfer roller 3 constituting a transfer section is arranged such that a paper conveying direction of the transfer roller 3 is set to an upward direction with respect to the belt supporting roller 10.

The hanging down characteristics of the rear end of a transferred paper sheet 5 are changed by this construction, so that a hanging-down amount of the transferred paper sheet 5 is restrained and a conveying locus of the transferred paper sheet is more horizontally formed. The transfer paper sheet 5 is easily fed more reliably into the nipping portion 11 by more horizontally forming the conveying locus of the transfer paper sheet 5.

Figure 9:
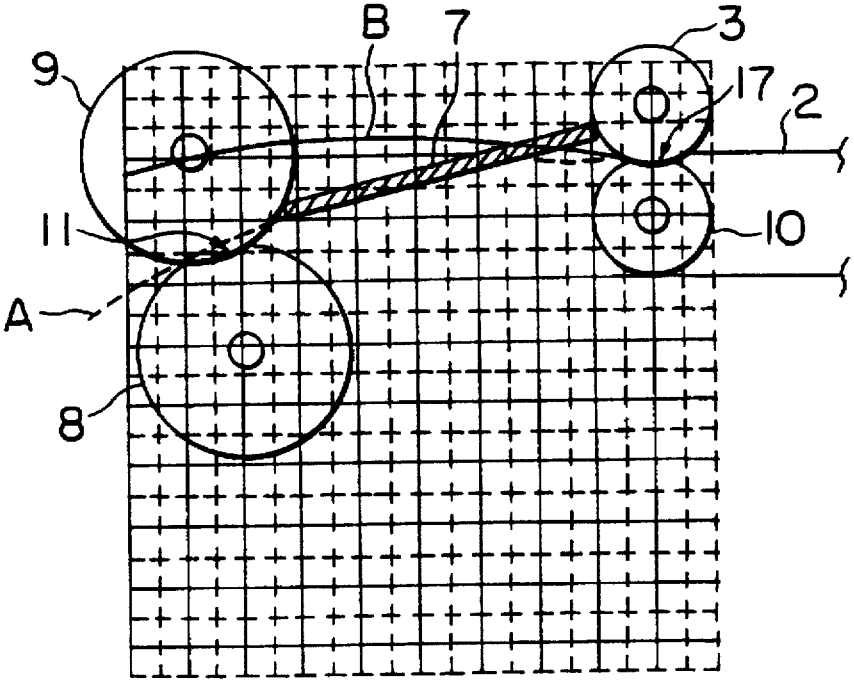
FIG. 9 is a schematic constructional view showing a paper conveyer in an embodiment based on a fourth construction of the present invention.

A basic construction of the embodiment based on the fourth construction is approximately similar to that of the embodiment of the first construction. The differences in construction between these embodiments are as follows. Namely, as shown in FIG. 9, a nipping portion 17 is formed in a concave shape by the transfer roller 3 and the belt supporting roller 10 such that a front end of the transfer paper sheet 5 is directed upward. Thus, operating effects similar to those of the third construction can be obtained.

Figure 10:
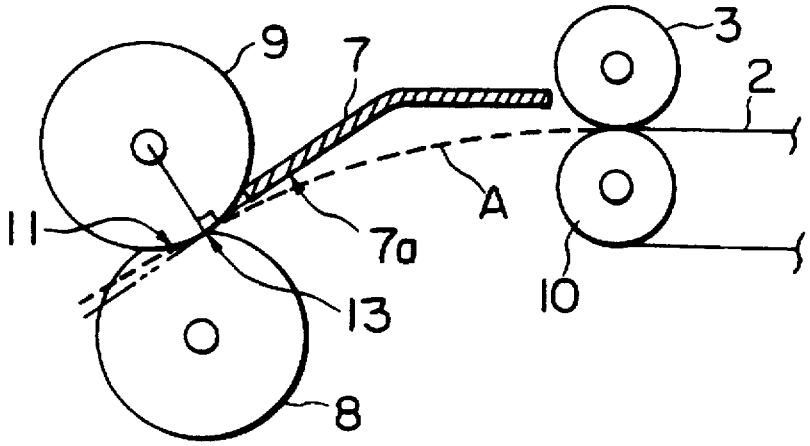
FIG. 10 is a schematic constructional view showing a paper conveyer in an embodiment based on a fifth construction of the present invention.

A basic construction of the embodiment based on the fifth construction is approximately similar to that of the embodiment of the first construction. The differences in construction between these embodiments are as follows. Namely, as shown in FIG. 10, an attaching position of the paper guide plate 7 is arranged such that an extending straight line included on a front end guide face 7*a* of the paper guide plate 7 is approximately perpendicular to a straight line connecting a center of the pressurizing roller 9 to the nipping inlet port point 13.

The transfer paper sheet 5 is guided by the nipping inlet port point 13 by this construction and is naturally fed into the nipping portion 11 without any problem while the transfer paper sheet 5 is slid along the paper guide plate 7.

Figure 11:
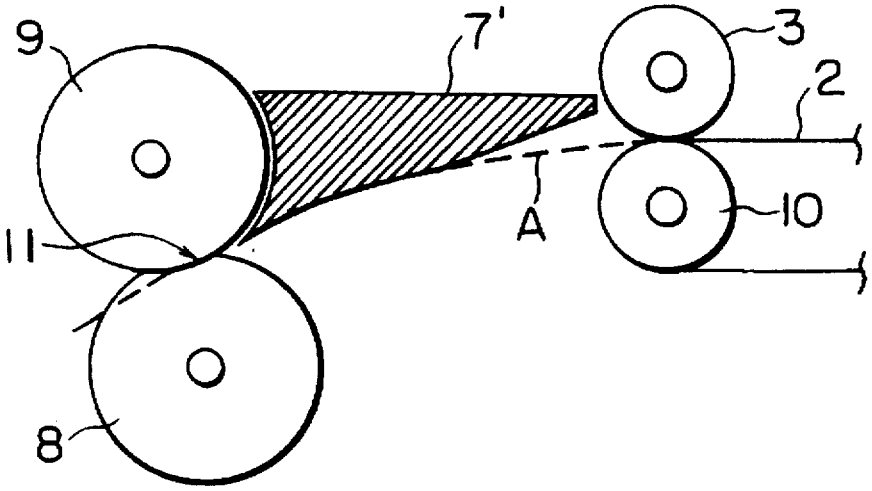
FIG. 11 is a schematic constructional view showing a paper conveyer in an embodiment based on a sixth construction of the present invention.

A basic construction of the embodiment based on the sixth construction is approximately similar to that of the embodiment of the first construction. The differences in construction between these embodiments are as follows. Namely, as shown in FIG. 11, one portion of the shape of a face of a paper guide plate 7' coming in slide contact with the transfer paper sheet 5 is formed to be approximately similar to the conveying locus A of a thin paper sheet shown in FIG. 3. Transfer paper sheets having various kinds of rigidities used in this apparatus are naturally guided to the nipping portion 11 by this construction without any problem while the transfer paper sheets are slid along the paper guide plate 7'.

Figure 12:
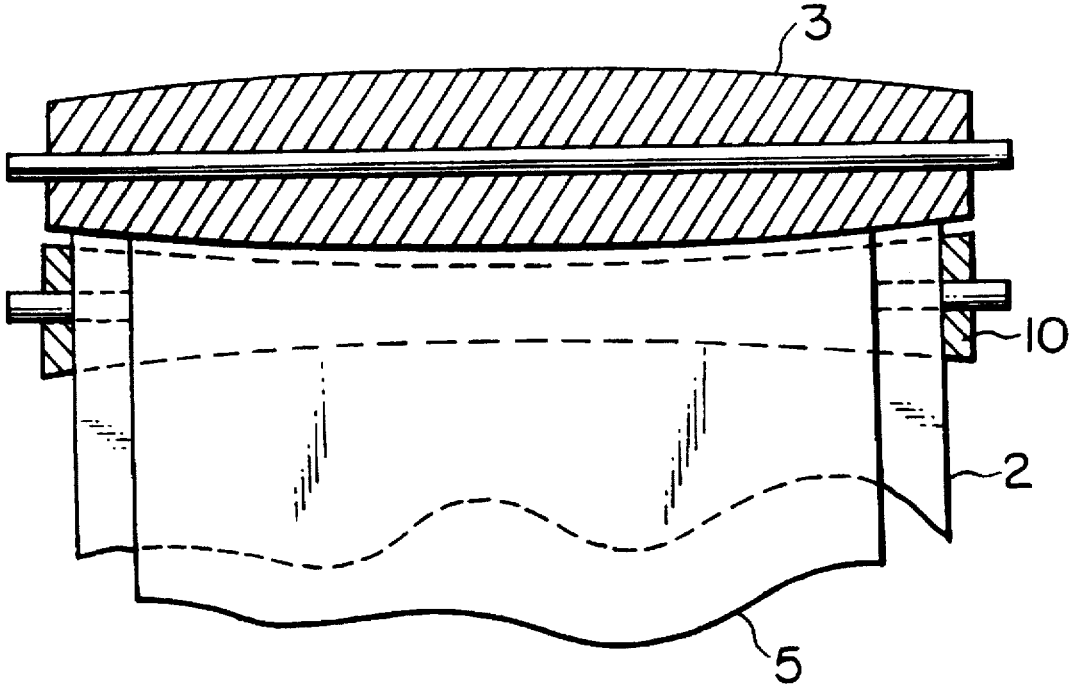
FIG. 12 is a schematic constructional view showing a paper conveyer in an embodiment based on a seventh construction of the present invention.

A basic construction of the embodiment based on the seventh construction is approximately similar to that of the embodiment of the first construction. The differences in construction between these embodiments are as follows. Namely, as shown in FIG. 12, one of the transfer roller 3 and the belt supporting roller 10 opposed to this transfer roller 3 is formed in a crown shape in which the one of these rollers is gradually thinned toward an axial center thereof. The other of these rollers is formed in a reverse crown shape accurately following this crown shape.

When the transfer paper sheet 5 fed from the transfer section passes between these rollers, a curved surface of the transfer paper sheet 5 is formed in accordance with a nipping shape of these rollers so that firmness and rigidity are provided to the transfer paper sheet. Therefore, as shown in the third construction, hanging-down characteristics of the transferred paper sheet 5 are changed so that a hanging-down amount of the transferred paper sheet 5 is greatly restrained. Thus, a conveying locus of the transfer paper sheet 5 is more horizontally formed so that operating effects similar to those of the third construction can be obtained.

As explained above, in accordance with the first construction, hardness of the fixing roller is smaller than that of the pressurizing roller. A nipping shape of the transfer paper sheet is formed in a concave shape by a press contact of the fixing and pressurizing rollers. The fixing roller and the pressurizing roller are arranged such that a nipping inlet port point of these rollers is located in the vicinity of a line of a conveying locus of a thin paper sheet, such that a transfer paper sheet having the smallest rigidity among transfer paper sheets used in this image forming apparatus is conveyed from a transfer position to a fixing position of the fixing device. A paper guide plate for guiding the transfer paper sheet from the transfer position to the nipping inlet port is arranged such that the transfer paper sheet is guided in slide contact with the paper guide plate between the transfer roller and the fixing device. Accordingly, the transfer paper sheet is reliably fed from a transfer section to a fixing section along the paper guide plate irrespective of a large or small value of rigidity of the transfer paper sheet. Therefore, it is possible to prevent an unfixed image from being rubbed and prevent a jam of the transfer paper sheet in the nipping inlet port and wrinkles of the transfer paper sheet within the nipping portion, etc. from being caused.

In accordance with the second construction, the fixing roller and the pressurizing roller are arranged such that a straight line connecting a center of this pressurizing roller to the nipping inlet port point is approximately perpendicular to a tangential line at a point on the thin paper conveying locus at this nipping inlet port point or a point on the thin paper conveying locus in the vicinity of the nipping inlet port point. Accordingly, the transfer paper sheet is naturally fed from the nipping inlet port into the nipping portion without any problem. Therefore, it is possible to prevent wrinkles and a jam of the transfer paper sheet from being caused.

In accordance with the third construction, the transfer roller and the intermediate transfer member are arranged such that a front end of the transfer paper sheet passing through a passing through a nipping portion of the transfer roller and the intermediate transfer member is directed upward. Accordingly, a scatter of a conveying locus caused by large or small rigidity of the transfer paper sheet is reduced so that the transfer paper sheet is more reliably fed into the nipping portion. Further, it is not necessary to lower a position of the fixing device so that a space for lowering the fixing device can be omitted. Therefore, the entire image forming apparatus can be made compact and a height of the image forming apparatus can be particularly reduced.

In accordance with the fourth construction, a hardness of the transfer roller is set to be larger than a hardness of the intermediate transfer member. A nipping shape of the transfer roller and the intermediate transfer member is set to a concave shape such that a front end of the transfer paper sheet passing through a nipping portion of the transfer roller and the intermediate transfer member is directed upward. Accordingly, effects similar to those of the third construction can be obtained.

In accordance with the fifth construction, the paper guide plate is arranged such that:

a guide face of the paper guide plate at its front end is approximately perpendicular to a straight line connecting a center of the pressurizing roller to the nipping inlet port point; and an extension line of a straight line included on the guide face of the paper guide plate at its front end is located at the nipping inlet port point or is located above and near the nipping inlet port point. Accordingly, the transfer paper sheet is directly fed to the nipping inlet port, or passes through the front end of the paper guide plate. Thereafter, the transfer paper sheet is naturally fed into the nipping portion without any problem while the transfer paper sheet is guided by the pressurizing roller. Thus, effects similar to those of the second construction can be obtained.

In accordance with the sixth construction, the paper guide plate is constructed such that one face portion of the paper guide plate which comes into sliding contact with the transfer paper sheet is formed in a shape approximately conforming to the thin paper conveying locus. Accordingly, the transfer paper sheet is smoothly conveyed since resistance of the transfer paper sheet is reduced when the transfer paper sheet is conveyed in slide contact with the paper guide plate. Thus, it is possible to reliably prevent the transfer paper sheet from being jammed near the nipping inlet port irrespective of large or small rigidity of the transfer paper sheet.

In accordance with the seventh construction, one of the transfer roller and the intermediate transfer member is formed in a crown shape in which this one is gradually thinned toward its axial central portion. The other is formed in a reverse crown shape following this crown shape in which the other comes in contact with the one of the transfer roller and the intermediate transfer member. Accordingly, the transfer paper sheet has firmness so that rigidity is provided to the transfer paper sheet. Thus, a hanging-down amount of a transferred paper sheet is restrained so that a conveying locus of the transferred paper sheet is close to a horizontal locus. Accordingly, effects similar to those of the third construction can be obtained.

Many widely different embodiments of the present invention may be constructed without departing from the spirit and scope of the present invention. It should be understood that the present invention is not limited to the specific embodiments described in the specification, except as defined in the appended claims.

What is claimed is:

1. A paper conveyer of an image forming apparatus in a system in which a transfer operation is performed by a transfer device, an unfixed image in the transfer operation is carried onto a lower side of a transfer paper sheet, and the transfer paper sheet is conveyed to a fixing device constructed by a fixing roller and a pressurizing roller, wherein;

the fixing roller and the pressurizing roller are arranged such that a nipping inlet point between the fixing roller and the pressurizing roller is located in a vicinity of a line of a conveying locus of a thin paper sheet which is representative of a transfer paper sheet of transfer paper sheets having the smallest rigidity such that said thin paper sheet conveying locus is approximately along a conveyance path of the transfer paper sheet having the smallest rigidity which extends from a transfer position to a fixing position of the fixing device; and the paper conveyer has a paper guide plate for guiding the transfer paper sheet from the transfer position to said nipping inlet point, the paper guide plate being arranged such that the transfer paper sheet is guided in sliding contact with the paper guide plate between said transfer device and said fixing device.

2. A paper conveyer of an image forming apparatus as claimed in claim 1, wherein said fixing roller and said pressurizing roller are arranged such that a straight line connecting a center of the pressurizing roller to said nipping inlet point is approximately perpendicular to a tangential line at a point on the thin paper sheet conveying locus at the nipping inlet point or a point on the thin paper sheet conveying locus in a vicinity of the nipping inlet point.

3. A paper conveyer of an image forming apparatus as claimed in claim 1, wherein a nipping shape of the transfer paper sheet is formed in a concave shape on a pressurizing roller side by a press contact of the fixing roller and the pressurizing roller.

4. A paper conveyer of an image forming apparatus as claimed in claim 3, wherein a hardness of said fixing roller is smaller than a hardness of said pressurizing roller.

5. A paper conveyer of an image forming apparatus as claimed in claim 4, wherein each of the fixing roller and the pressurizing roller is constructed by an elastic member.

6. A paper conveyer of an image forming apparatus as claimed in claim 1, wherein the transfer device comprises a transfer roller and an intermediate transfer member which come into pressing contact with the transfer roller.

7. A paper conveyer of an image forming apparatus as claimed in claim 6, wherein said transfer roller and said intermediate transfer member are arranged such that a front end of said transfer paper sheet passing through a nipping portion of the transfer roller and the intermediate transfer member is directed upward.

8. A paper conveyer of an image forming apparatus as claimed in claim 6, wherein a hardness of said transfer roller is set to be larger than a hardness of said intermediate transfer member; and a nipping shape of the transfer roller and the intermediate transfer member is set to a concave shape such that a front end of said transfer paper sheet passing through a nipping portion of the transfer roller and the intermediate transfer member is directed upward.

9. A paper conveyer of an image forming apparatus as claimed in claim 1, wherein said paper guide plate is arranged such that;

a front end of a guide face of the paper guide plate is approximately perpendicular to a straight line which connects a center of said pressurizing roller to said nipping inlet point; and an extension line of a straight line on the front end of said guide face of the paper guide plate is located at the nipping inlet point or is located above and near the nipping inlet point.

10. A paper conveyer of an image forming apparatus as claimed in claim 1, wherein said paper guide plate is constructed such that one face portion of the paper guide plate which comes into sliding contact with said transfer paper sheet is formed in a shape approximately conforming to said thin paper sheet conveying locus.

11. A paper conveyer of an image forming apparatus as claimed in claim 6, wherein one of said transfer roller and said intermediate transfer member is formed in a crown shape, in which said one of said transfer roller and said intermediate transfer member is gradually thinned toward its axial central portion; and the other of said transfer roller and said intermediate transfer member is formed in a reverse crown shape which follows said crown shape, such that the other of said transfer roller and said intermediate transfer member comes in contact with said one of the transfer roller and the intermediate transfer member.

12. A paper conveyer of an image forming apparatus as claimed in claim 1, wherein the nipping inlet point of the fixing and pressurizing rollers is arranged near and below the thin paper sheet conveying locus.

* * * * *